US008028768B2

(12) United States Patent
Hall et al.

(10) Patent No.: US 8,028,768 B2
(45) Date of Patent: Oct. 4, 2011

(54) DISPLACEABLE PLUG IN A TOOL STRING FILTER

(75) Inventors: David R. Hall, Provo, UT (US); Paula Turner, Pleasant Grove, UT (US); David Lundgreen, Provo, UT (US)

(73) Assignee: Schlumberger Technology Corporation, Houston, TX (US)

( * ) Notice: Subject to any disclaimer, the term of this patent is extended or adjusted under 35 U.S.C. 154(b) by 135 days.

(21) Appl. No.: 12/405,480

(22) Filed: Mar. 17, 2009

(65) Prior Publication Data

US 2010/0236833 A1 Sep. 23, 2010

(51) Int. Cl.
*E21B 43/08* (2006.01)
*E03B 3/18* (2006.01)

(52) U.S. Cl. ..... 175/314; 166/205

(58) Field of Classification Search ..... 175/314; 166/205

See application file for complete search history.

(56) References Cited

U.S. PATENT DOCUMENTS 1,445,363 A * 2/1923 Smith ..... 137/515.3
2,414,719 A 1/1947 Cloud
3,145,783 A * 8/1964 Sibley ..... 175/19
3,302,722 A * 2/1967 Madeley, Sr. ..... 166/157
3,450,207 A * 6/1969 Hirsch ..... 166/233
3,518,608 A 6/1970 Papadopoulos
4,495,073 A 1/1985 Beimgraben
4,739,325 A 4/1988 MacLeod
4,788,544 A 11/1988 Howard
5,664,628 A 9/1997 Koehler et al.
6,012,015 A 1/2000 Tubel
6,155,342 A * 12/2000 Oneal et al. ..... 166/51
6,252,518 B1 6/2001 Laborde
6,296,055 B1 * 10/2001 Taylor ..... 166/205
6,392,317 B1 5/2002 Hall et al.
6,589,685 B2 7/2003 Mizuno et al.
6,598,685 B1 * 7/2003 Mashburn ..... 175/57
6,670,880 B1 12/2003 Hall et al.
6,684,951 B2 2/2004 Restarick
6,688,396 B2 2/2004 Floerke et al.
6,717,501 B2 4/2004 Hall et al.
6,799,632 B2 10/2004 Hall et al.
6,799,645 B2 * 10/2004 Mason et al. ..... 175/57
6,821,147 B1 11/2004 Hall et al.
6,830,467 B2 12/2004 Hall et al.
6,844,498 B2 1/2005 Hall et al.
6,866,306 B2 3/2005 Boyle et al.
6,888,473 B1 5/2005 Hall et al.
6,913,093 B2 7/2005 Hall et al.
6,929,493 B2 8/2005 Hall et al.
6,945,802 B2 9/2005 Hall et al.
6,968,611 B2 11/2005 Hall et al.
6,976,546 B2 12/2005 Herst
7,165,633 B2 * 1/2007 Hall et al. ..... 175/314

(Continued)

FOREIGN PATENT DOCUMENTS

CN 201363100 Y * 12/2009

*Primary Examiner* — Jennifer H Gay
(74) *Attorney, Agent, or Firm* — Brinks Hofer Gilson & Lione

(57) ABSTRACT

A filter for a drill string comprises a perforated receptacle having an upper end and a lower end. The upper end of the filter comprises a drilling mud intake, and the lower end of the filter comprises an opening. A displaceable plug is seated on the opening at the lower end.

14 Claims, 7 Drawing Sheets

U.S. PATENT DOCUMENTS

| | | | | |
|---|---|---|---|---|
| 7,188,688 | B1 * | 3/2007 | LeJeune | 175/312 |
| 7,243,742 | B2 * | 7/2007 | Kutryk | 175/314 |
| 7,275,594 | B2 * | 10/2007 | Hall et al. | 166/241.1 |
| 7,303,029 | B2 * | 12/2007 | Hall et al. | 175/314 |
| 2003/0150616 | A1 * | 8/2003 | Mashburn | 166/311 |
| 2004/0079551 | A1 * | 4/2004 | Herst | 175/57 |
| 2004/0104797 | A1 | 6/2004 | Hall et al. | |
| 2004/0113808 | A1 | 6/2004 | Hall et al. | |
| 2004/0145492 | A1 | 7/2004 | Hall et al. | |
| 2004/0150532 | A1 | 8/2004 | Hall et al. | |
| 2004/0164833 | A1 | 8/2004 | Hall et al. | |
| 2004/0164838 | A1 | 8/2004 | Hall et al. | |
| 2004/0216847 | A1 | 11/2004 | Hall et al. | |
| 2004/0244916 | A1 | 12/2004 | Hall et al. | |
| 2004/0244964 | A1 | 12/2004 | Hall et al. | |
| 2004/0246142 | A1 | 12/2004 | Hall et al. | |
| 2005/0001735 | A1 | 1/2005 | Hall et al. | |
| 2005/0001736 | A1 | 1/2005 | Hall et al. | |
| 2005/0001738 | A1 | 1/2005 | Hall et al. | |
| 2005/0035874 | A1 | 2/2005 | Hall et al. | |
| 2005/0035875 | A1 | 2/2005 | Hall et al. | |
| 2005/0035876 | A1 | 2/2005 | Hall et al. | |
| 2005/0036507 | A1 | 2/2005 | Hall et al. | |
| 2005/0039912 | A1 | 2/2005 | Hall et al. | |
| 2005/0045339 | A1 | 3/2005 | Hall et al. | |
| 2005/0046586 | A1 | 3/2005 | Hall et al. | |
| 2005/0046590 | A1 | 3/2005 | Hall et al. | |
| 2005/0067159 | A1 | 3/2005 | Hall et al. | |
| 2005/0070144 | A1 | 3/2005 | Hall et al. | |
| 2005/0082092 | A1 | 4/2005 | Hall et al. | |
| 2005/0092499 | A1 | 5/2005 | Hall et al. | |
| 2005/0093296 | A1 | 5/2005 | Hall et al. | |
| 2005/0095827 | A1 | 5/2005 | Hall et al. | |
| 2005/0109503 | A1 * | 5/2005 | Kutryk | 166/227 |
| 2005/0115717 | A1 | 6/2005 | Hall et al. | |
| 2005/0145406 | A1 | 7/2005 | Hall et al. | |
| 2005/0150653 | A1 | 7/2005 | Hall et al. | |
| 2005/0161215 | A1 | 7/2005 | Hall et al. | |
| 2005/0173128 | A1 | 8/2005 | Hall et al. | |
| 2005/0212530 | A1 | 9/2005 | Hall et al. | |
| 2005/0236160 | A1 | 10/2005 | Hall et al. | |
| 2005/0279508 | A1 | 12/2005 | Hall et al. | |
| 2005/0284659 | A1 | 12/2005 | Hall et al. | |
| 2005/0284662 | A1 | 12/2005 | Hall et al. | |
| 2005/0284663 | A1 | 12/2005 | Hall et al. | |
| 2005/0285645 | A1 | 12/2005 | Hall et al. | |
| 2005/0285705 | A1 | 12/2005 | Hall et al. | |
| 2005/0285706 | A1 | 12/2005 | Hall et al. | |
| 2005/0285751 | A1 | 12/2005 | Hall et al. | |
| 2005/0285752 | A1 | 12/2005 | Hall et al. | |
| 2005/0285754 | A1 | 12/2005 | Hall et al. | |
| 2006/0065443 | A1 * | 3/2006 | Hall et al. | 175/314 |
| 2006/0065444 | A1 * | 3/2006 | Hall et al. | 175/314 |
| 2010/0236833 | A1 * | 9/2010 | Hall et al. | 175/314 |

* cited by examiner

DISPLACEABLE PLUG IN A TOOL STRING FILTER

BACKGROUND OF THE INVENTION

Oil and gas well drilling operations typically require drilling mud to be circulated throughout the system. As drilling mud is recirculated during downhole drilling operations, debris from earth formations, drill bit cuttings, shavings, and other abrasive articles may damage sensitive downhole equipment. Filters used to collect the debris are known in the art. Often these filters are placed in an uppermost drill pipe of a drill string. As new pipe is added to the drill string, the filter is removed, dumped out and cleaned, hoisted to the top of the derrick, and placed into the newly attached uppermost pipe in the drill string.

U.S. Pat. No. 7,165,633 to Hall et al., which is herein incorporated by reference for all that it contains, discloses a drilling fluid filter for placement within a bore of a tubular drill string component. The drilling fluid filter includes a perforated receptacle with an open end and a closed end. A hanger for engagement with the wall is mounted at the open end of the perforated receptacle. A mandrel is adjacent and attached to the open end of the perforated receptacle. A linkage connects the mandrel to the hanger. The linkage may be selected from the group consisting of struts, articulated struts and cams. The mandrel operates on the hanger through the linkage to engage and disengage the drilling fluid filter from the tubular drill string component. The mandrel may have a stationary portion having a first attachment to the open end of the perforated receptacle and a telescoping adjustable portion having a second attachment to the linkage. The mandrel may also have a top-hole interface for top-hole equipment.

U.S. Pat. No. 7,275,594 to Hall et al., which is herein incorporated by reference for all that it contains, discloses a tool string stab guide for axially aligning first tool string components with second tool string components. The stab guide has a body with an axial length along a longitudinal axis with a first and a second section. The first section of the body is adapted for removable attachment within a bore of a tool string component. The second section of the body has a centering element with a flow channel. The ratio of the axial length to the diameter is at least 2:1.

U.S. Pat. No. 7,303,029 to Hall et al., which is herein incorporated by reference for all it contains, discloses a filter for a drill string comprising a perforated receptacle having an open end, a perforated end, a first mounting surface adjacent to the open end and a second mounting surfaces adjacent to the open end. A transmission element is disposed within each of the first mounting surface and the second mounting surface. A capacitor may modify electrical characteristics of an LC circuit that are a part of the transmission elements. The respective transmission elements are in communication with each other and with a transmission network integrated into the drill string. The transmission elements may be inductive couplers, direct electrical contacts, or optical couplers. In some embodiments, the filter includes an electronic component. The electronic component may be selected from the group consisting of a sensor, a router, a power source, a clock source, a repeater, and an amplifier.

U.S. Pat. No. 6,976,546 to Herst, which is herein incorporated by reference for all that it contains, discloses a filter system for filtering drill bit cuttings, shavings, and other abrasive articles from a drilling mud that is passed through an oil or gas well drilling system that includes an overhead drilling system, a drill string connected to the overhead drilling system, and a mud filter for filtering the drilling mud, wherein the mud filter is disposed within a drilling mud fluid passage that extends from the entry point of the drilling mud into the overhead drilling system and the entry point of the drilling mud into the drill string.

BRIEF SUMMARY OF THE INVENTION

A filter for a drill string includes a perforated receptacle having an upper end and a lower end. The upper end of the filter has a drilling mud intake, and the lower end of the filter has an opening. A displaceable plug is seated on the opening at the lower end.

The displaceable plug may be a ball, a disc, or a seal. The displaceable plug may have a stopper proximate the lower end. A first end of a shaft may be attached to the stopper, while a second end of the shaft may extend towards the upper end of the filter. The second end of the shaft may be attached to a spider. The displaceable plug may seat within the lower end of the perforated receptacle or on an exterior of the lower end of the perforated receptacle. The displaceable plug may be threadably attached to the lower end of the perforated receptacle. The displaceable plug may include pins receivable within grooves. The pins may be utilized to seat the displaceable plug.

The perforated receptacle may have a substantially conical shape. The perforated receptacle may include at least one rod and a coil circumferentially disposed around the at least one rod. The perforated receptacle may have perforations that are shaped as circles, squares, ovals, rectangles or other shapes. The perforated receptacle may be disposed within a saver sub or swivel. The lower end of the perforated receptacle may have a detachable part. A structure having bristles may be disposed within the filter.

DETAILED DESCRIPTION OF THE INVENTION AND THE PREFERRED EMBODIMENT

Figure 1:
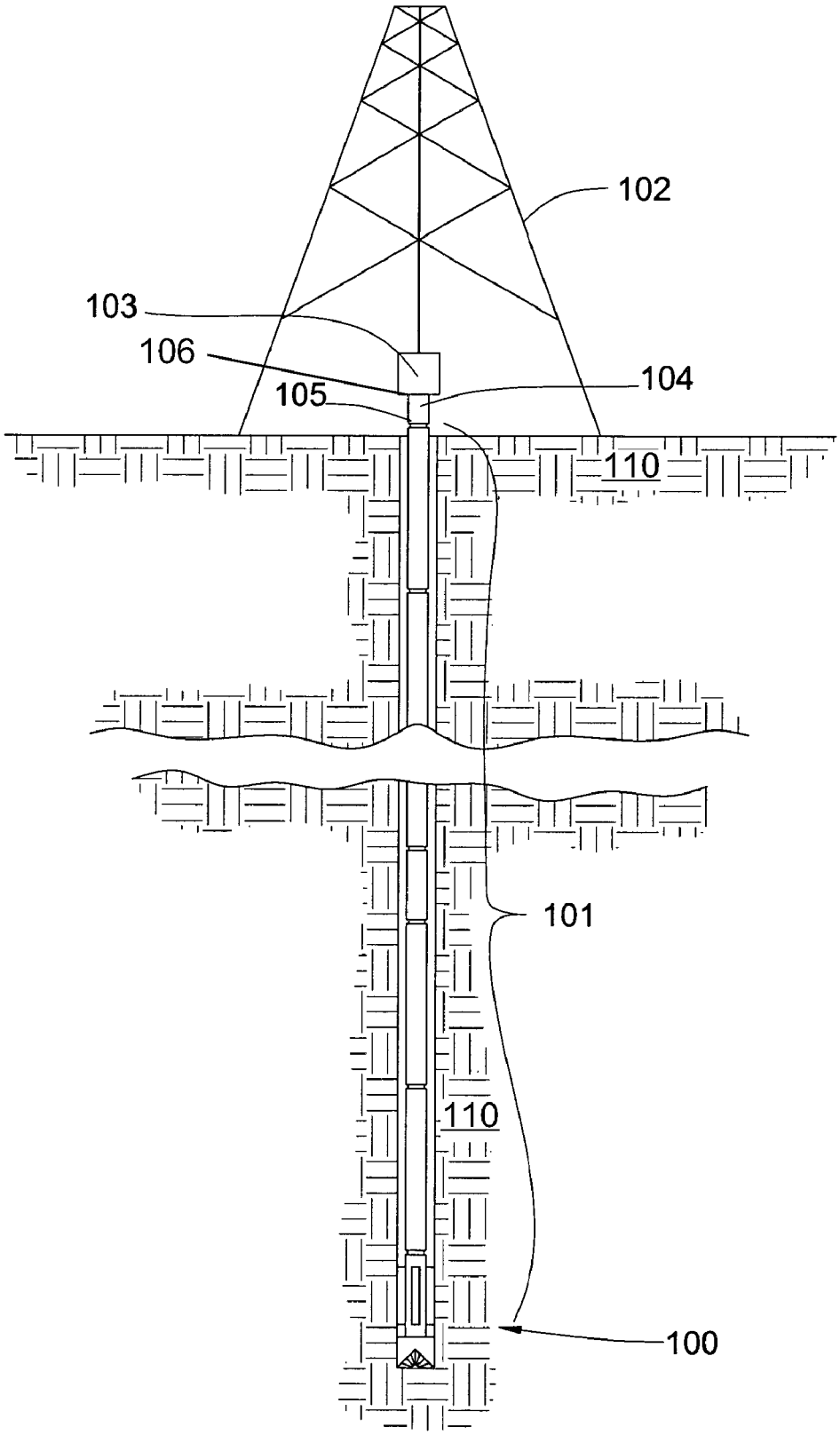
FIG. 1 is a cross-sectional diagram of an well bore illustrating an embodiment of a downhole drill string.

Referring now to FIG. 1, a drill string 101 may be suspended by a derrick 102. The drill string 101 may comprise one or more downhole components 100, linked together in a the drill string 101. The drill string 101 may be in communication with an uphole assembly 103. The uphole assembly 103 may have a kelly drive or a top-drive. The drill string 101 may include a saver sub 104. An upper end 106 of the saver sub 104 may be attached to the uphole assembly 103. A lower end 105 of the saver sub 104 may attach to the drill string 101. As the drill string 101 advances into the earth 110 additional downhole components 100 may be added to the drill string 101 at the lower end 105 of the saver sub 104.

Figure 2:
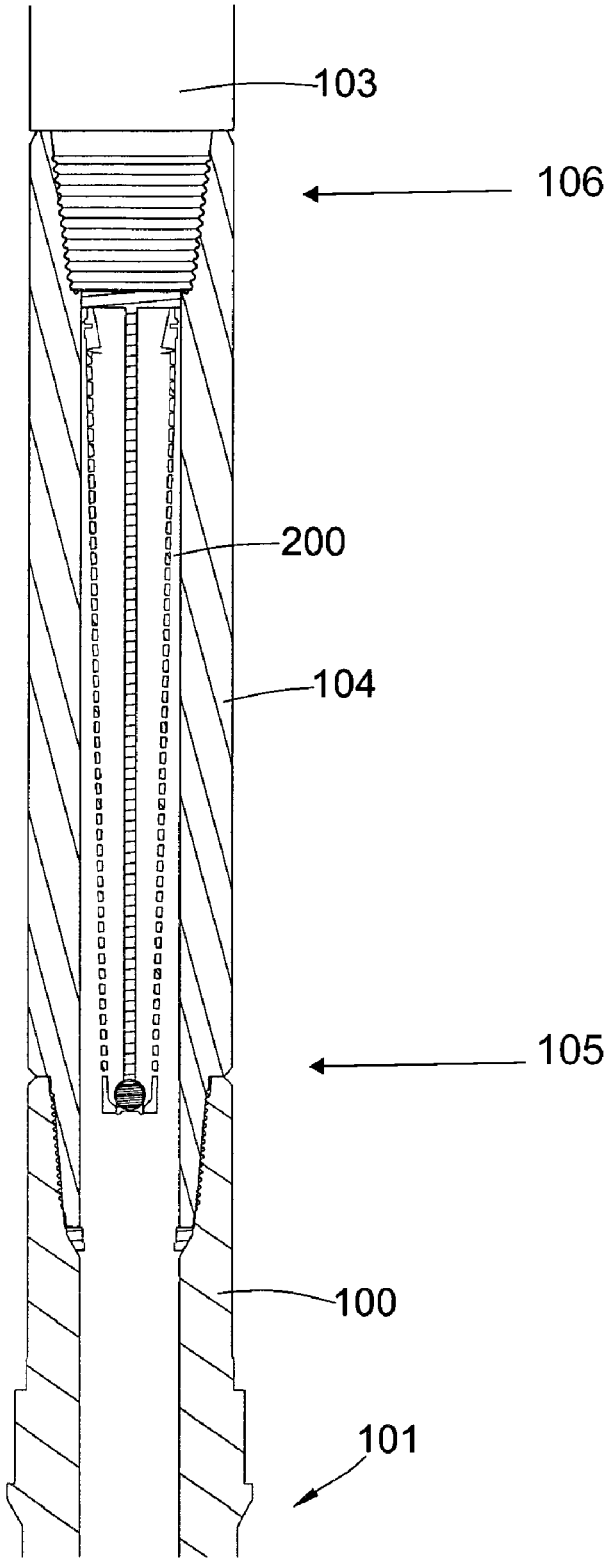
FIG. 2 is a cross-sectional diagram of a drill pipe illustrating an embodiment of a filter.

FIG. 2 is a diagram depicting an embodiment of a drill string filter 200 disposed within the saver sub 104 of FIG. 1. The saver sub 104 may be placed intermediate the uphole assembly 103 and the drill string 101. The saver sub 104 may also be utilized as a break joint for adding new downhole components 100 as the drill string 101 advances farther into the earth 110. The saver sub 104 may remain in communication with the uphole assembly 103 while new pipe is being added to the drill string 101.

Figure 3A:
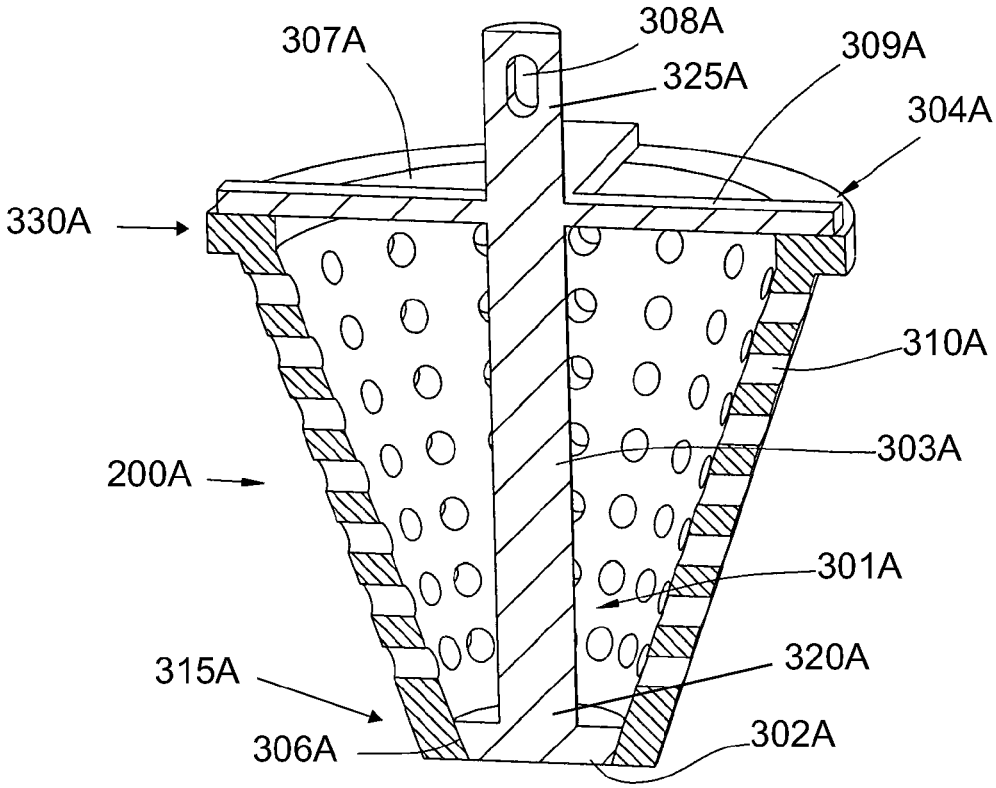
FIG. 3*a* is a cross-sectional diagram of an embodiment of a filter for a drill string.

FIG. 3*a* is a diagram depicting an embodiment of a drill string filter 200A suitable for use in the drill string 101. The filter 200A may have a perforated receptacle 310A and a displaceable plug 301A. The displaceable plug 301A may have a stopper 302A, a shaft 303A, a spider 304A, and a through-hole 308A. When the displaceable plug 301A is seated, the stopper 302A may obstruct a port 306A in a lower end 315A of the filter 200A. A first end 320A of the shaft 303A may be attached to the stopper 302A. A second end 325A of the shaft 303 may extend towards an upper end 330A of the filter 200A. The second end 325A of the shaft 303A may be attached to or pass through a spider 304A. The spider 304A may have at least one bar 309A running perpendicular to the shaft 303A. In the embodiment of FIG. 3*a*, the spider 304A is adapted to seat on a drilling mud intake 307A.

During drilling operations the filter 200A may be disposed within the saver sub 104. The saver sub 104 may be attached to the uphole assembly 103. In some embodiments the filter 200A may be disposed within the uphole assembly 103. The uphole assembly 103 feeds drilling mud into the drill string 101 through the saver sub 104 and the filter 200A. The filter 200A serves the purpose of removing larger particles and debris from the drilling mud. The process of filtration may lead to a build up of particles and debris within the filter 200A. The removal of these particles and debris often occurs when new downhole components 100 are added to the drill string 101. Present embodiments of the filter 200A may be cleaned without requiring the physical removal of the filter 200A from the drill string 101. The filter 200A may be cleaned by inserting a rod into the lower end 315A of the filter 200A and displacing the displaceable plug 301A, allowing the buildup of particles and debris to flow around the displaceable plug 301A and out of the filter 200A.

By allowing the filter 200A to be cleaned from the lower end 315A, several benefits may be gained. Firstly, in many of the present embodiments of filters that are used in the oil industry, when a filter needs cleaning it must be removed from a drill string at the bottom of a derrick and then hoisted up to the top of the derrick to be inserted into the new uppermost pipe. This hoisting action creates potential for injury to the workers below the derrick as the filter is handled in the air above them.

A second benefit that may be gained is that of non-interference with certain downhole telemetry systems such the one disclosed in U.S. Pat. No. 6,670,880 to Hall, which is herein incorporated by reference for all that it discloses. Present embodiments of many drill string filters have been found to interfere with the communication signals transmitted through certain drill string telemetry systems.

Third, Embodiments of the present invention may save time because the filter does not need to be removed, but may simply be emptied while still in the top hole equipment of the drill rig. This may save considerable expense, as the time required to remove and reinstall a filter is expensive.

The through-hole 308A on top of the spider 304A provides an attachment point to completely remove the displaceable plug 301A from the filter 200A if that should ever become necessary. If the filter 200A was disposed within the saver sub 104 then the saver sub 104 may have to be detached from the uphole assembly 103 to access the through-hole 308A. If the filter 200A was disposed within the uphole assembly 103 then the uphole assembly 103 may have to be disassembled to allow access to the through-hole 308A.

Figure 3B:
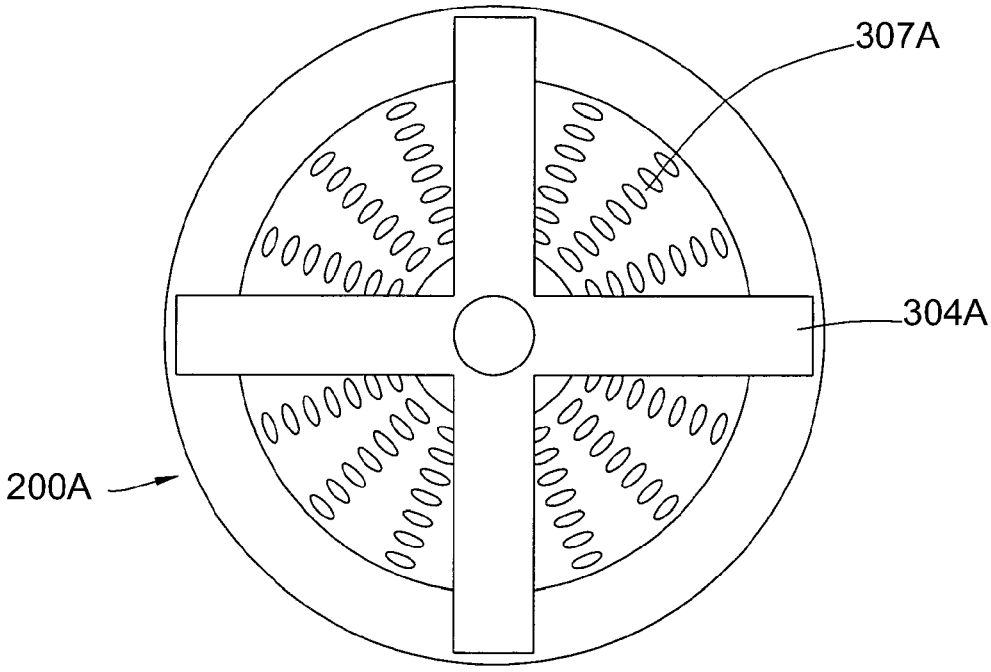
FIG. 3*b* is a top-view diagram of an embodiment of a filter for a drill string.

FIG. 3*b* depicts a top view of the embodiment of the filter shown in FIG. 3*a*. The spider 304A is shown seated upon the drilling mud intake 307A. The spider 304A may exert a downward force onto the rest of the displaceable plug 301A when drilling fluid is being pumped into the filter 200A. This downward force may act to further seat the displaceable plug 301A.

Figure 4A:
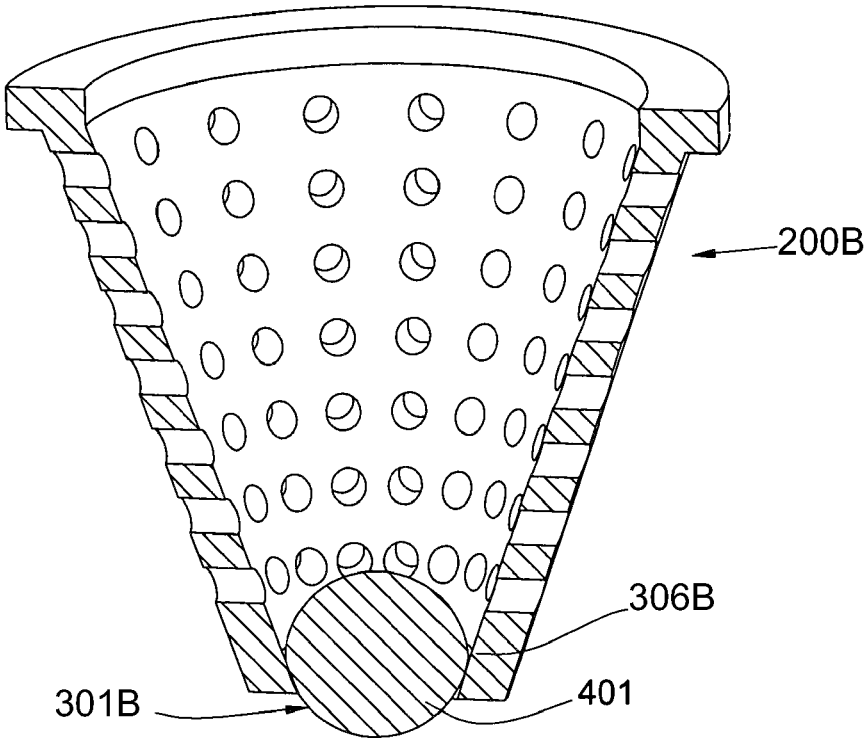
FIG. 4*a* is a cross-sectional diagram of another embodiment of a filter for a drill string.

FIG. 4*a* is a depiction of another embodiment of a drill string filter 200B. In this embodiment the filter 200B has a displaceable plug 301B in the form of a ball 401. The ball 401 is sized such that it lodges in a port 306B at a lower end 315B of the filter 200B. The filter 200B in this embodiment would also be cleaned by using a stick or pole to displace the ball 401 and allow the particles and debris to flow out.

Figure 4B:
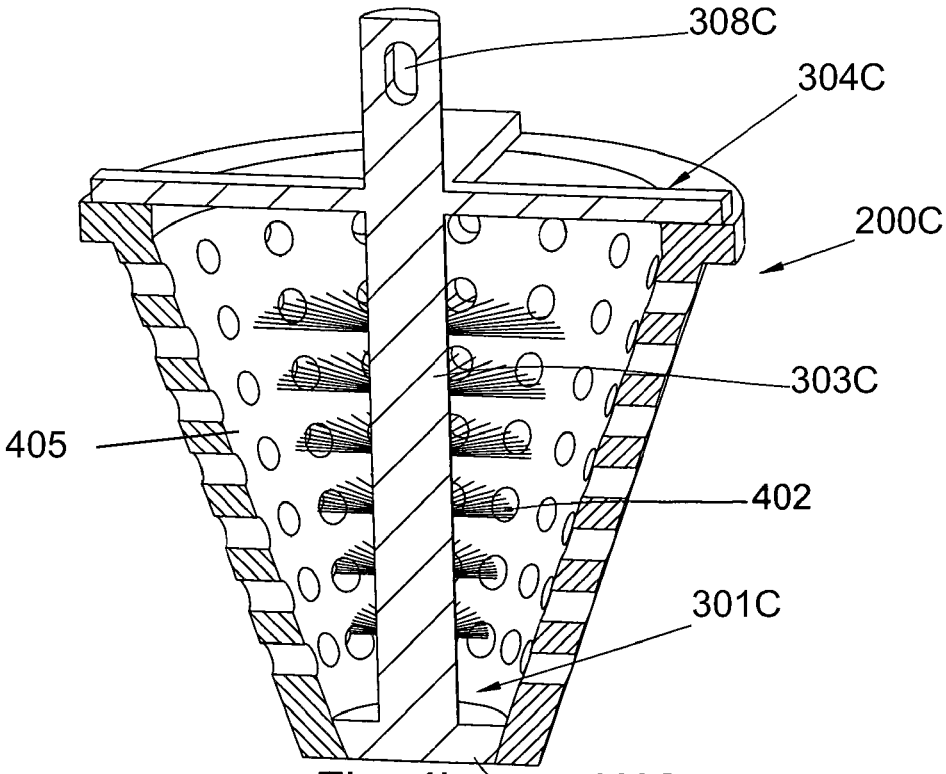
FIG. 4*b* is a cross-sectional diagram of another embodiment of a filter for a drill string.

FIG. 4*b* is a depiction of another embodiment of a drill string filter 200C. In this embodiment the filter 200C has a displaceable plug 301C. The displaceable plug 301C may comprise a stopper 302C, a spider 304C, and a shaft 303C having a through-hole 308C. The shaft 303C may have a set of bristles 402 extending perpendicularly outward towards an inner filter wall 405. The bristles 402 may provide additional filtering ability. The filter 200C in the embodiment would also be cleaned by using a stick or pole to displace the displaceable plug 301C and allow the particles and debris to flow out. Additional fluid may be required to run through the filter 200C during cleaning to remove the particles and debris from the bristles 402C.

Figure 5A:
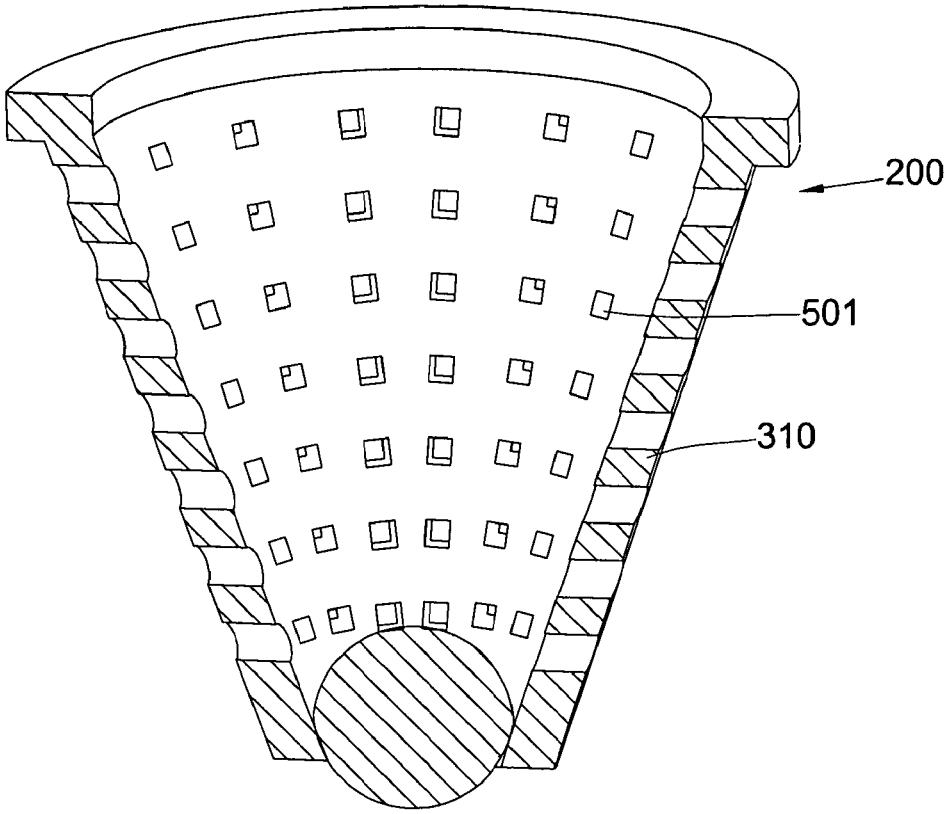
FIG. 5*a* is a cross-sectional diagram of another embodiment of a filter for a drill string.

FIG. 5*a* is a depiction of another embodiment of a filter 200D wherein a perforated receptacle 310D has perforations 501 in the shape of a square. The perforations 501 may be shaped in a variety of ways including but not limited to: square, circular, oval, slit, polygonal, or triangular. This embodiment would allow for use of any of the displaceable plugs that have previously been discussed.

Figure 5B:
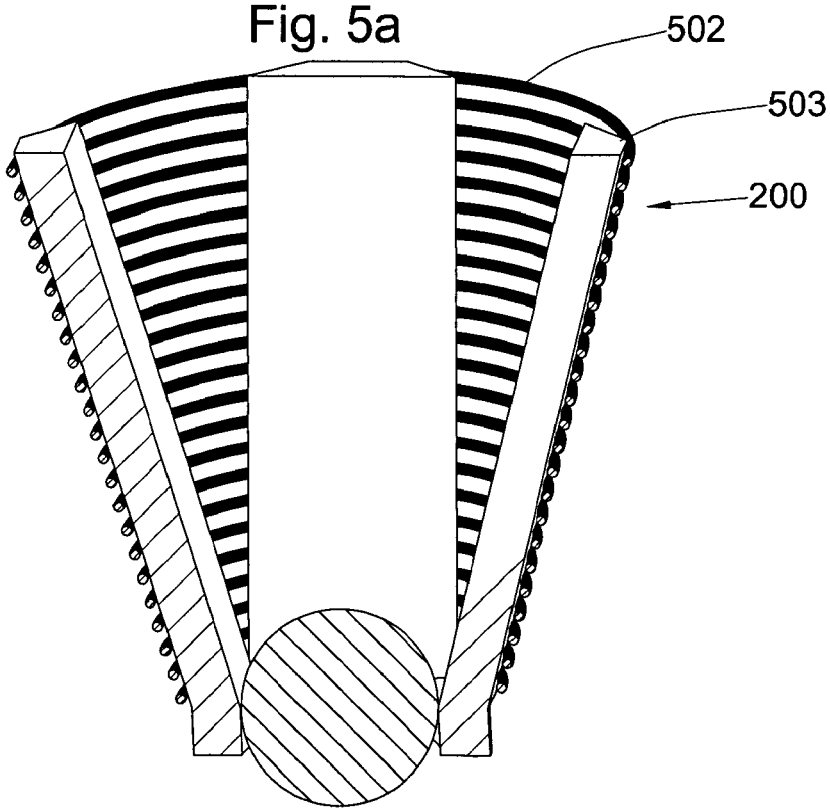
FIG. 5*b* is a cross-sectional diagram of another embodiment of a filter for a drill string.

FIG. 5*b* is a depiction of another embodiment of a filter 200E. In this embodiment, the perforations are gaps 505 between wires 502 which have been wrapped around a set of supporting rods 503. This embodiment would allow for use of any of the displaceable plugs that have previously been discussed.

Figure 6A:
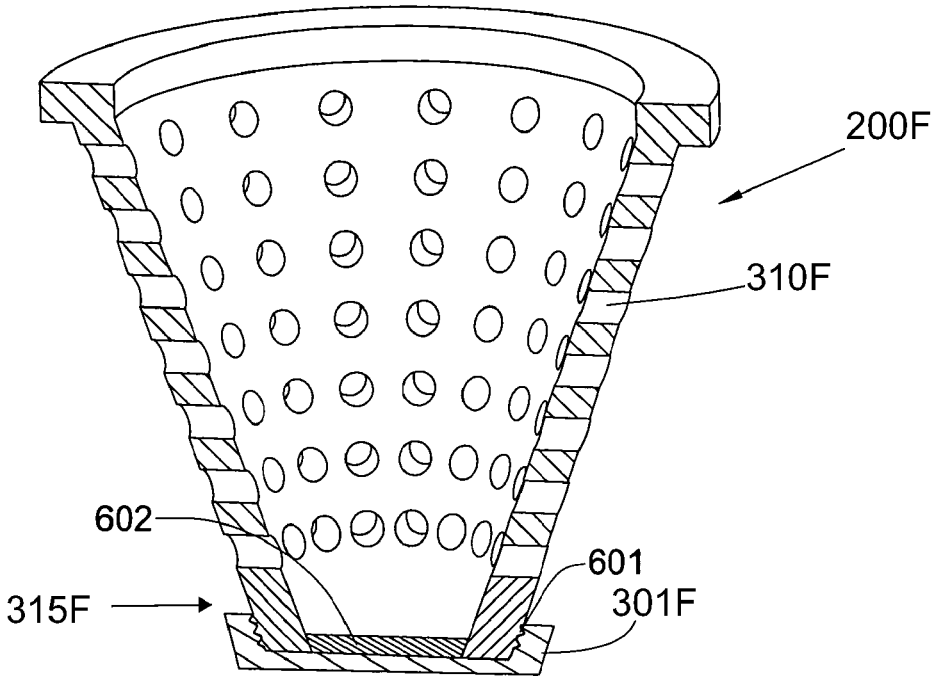
FIG. 6*a* is a cross-sectional diagram of another embodiment of a filter for a drill string.

FIG. 6*a* is a depiction of another embodiment of a filter 200F. In this embodiment, the filter 200F has a displaceable plug 301F. The displaceable plug 301F seats on an exterior of the lower end 315F of a perforated receptacle 310F. The displaceable plug 301F may seat on the perforated receptacle 310F through a thread form connection 601 or through a pin and groove connection (not shown). The displaceable plug 301F may have a seal 602. The seal 602 may aid in keeping debris within the filter 200F during operation. In this embodiment the filter would be cleaned by removing the displaceable plug 301F from an exterior of the perforated receptacle 310F. This embodiment may have the added benefit of allowing for the complete removal of the displaceable plug 301F from the filter 200F. The complete removal of the displaceable plug 301F may allow for more space for the particles and debris to exit the filter 200F.

Figure 6B:
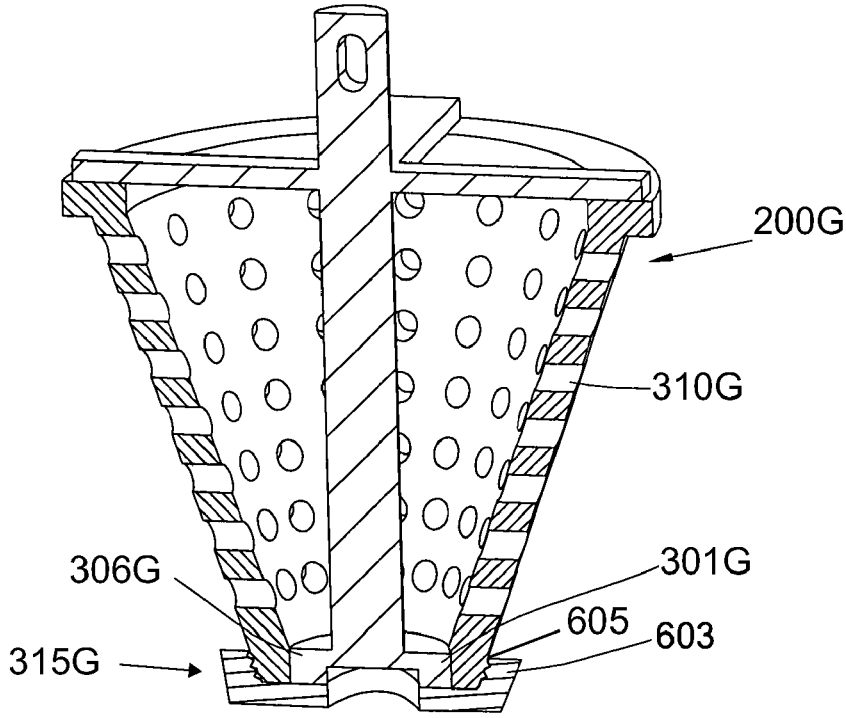
FIG. 6*b* is a cross-sectional diagram of another embodiment of a filter for a drill string.

FIG. 6*b* is a depiction of another embodiment of a filter 200G. In this embodiment the filter 200G comprises a displaceable plug 301G and a perforated receptacle 310G. The lower end 315G of the perforated receptacle 310G has a detachable part in the form of a keeper nut 603G. The displaceable plug 301G seats within the lower end 315G of the perforated receptacle 310G on the keeper nut 603. The keeper nut 603 may seat on an exterior of the lower end 315G of the perforated receptacle 310G. The keeper nut 603 may be in communication with the perforated receptacle 310G through a threadform 605 or through a pin and groove connection (not shown). This embodiment may have the added benefit of providing for a larger port 306G in the lower end 315G of the perforated receptacle 310G. If the opening provided by displacing the displaceable plug 301G did not allow adequate room for the expulsion of debris and particles then the keeper nut could be removed to increase the size of the port 306G.

Figure 7:
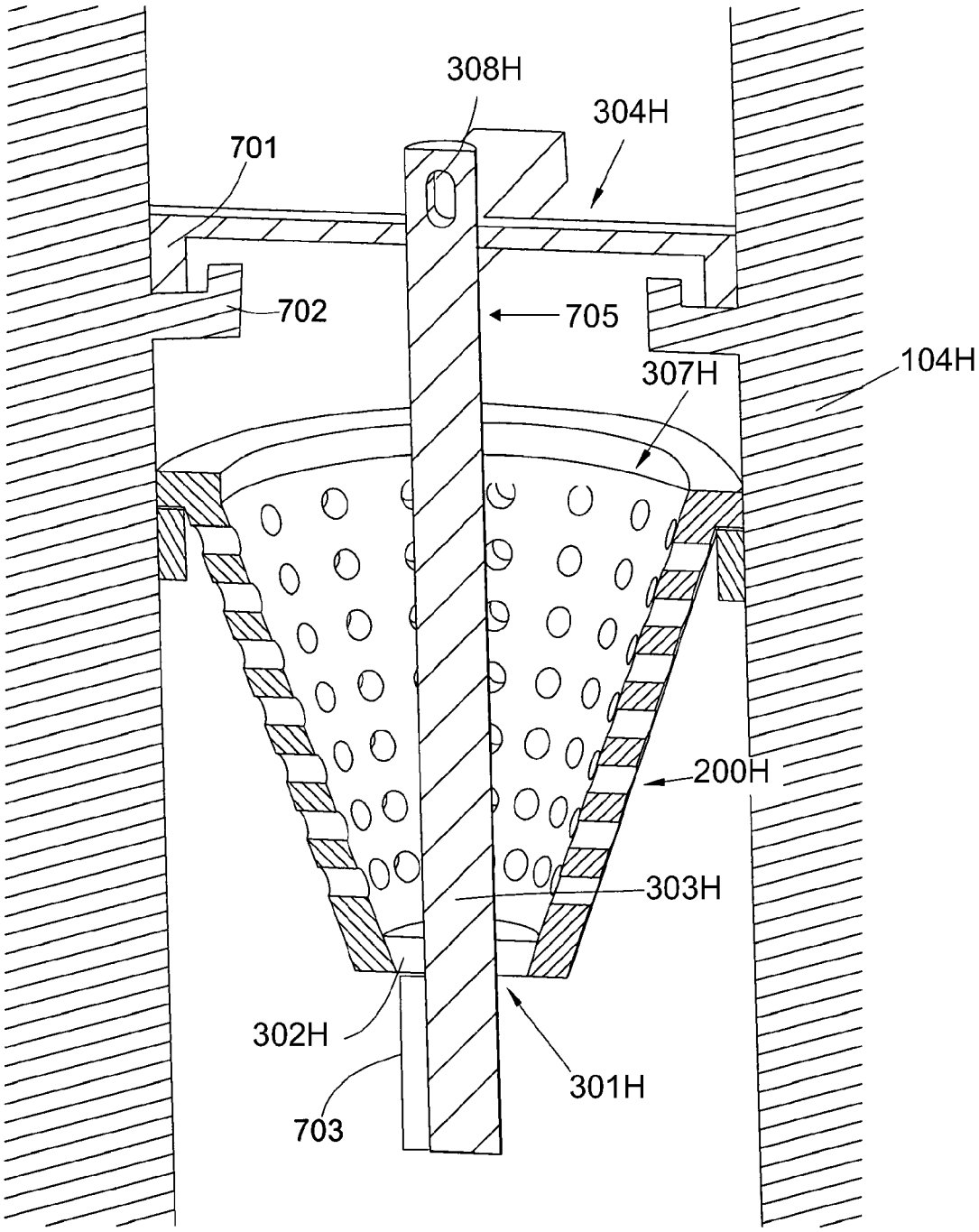
FIG. 7 is a cross-sectional diagram of a drill string component illustrating an embodiment of a filter.

FIG. 7 is a depiction of another embodiment of a filter 200H. In this embodiment, the filter 200H is disposed within a saver sub 104H. The filter 200H has a displaceable plug 301H. The displaceable plug 301H may have a stopper 302H, a spider 304H, and a shaft 303H having a through-hole 308H. An upper end 705 of the shaft 303H may extend above a drilling mud intake 307H. A spider 304H may be attached to the upper end 705 of the shaft 303H. The spider 304H may have catches 701 that interface with receivers 702 within the saver sub 104H. A lower end 703 of the shaft 303H may extend beyond the stopper 302H into a space below the filter 200H. The lower end 703 of the shaft 303H may function as a handle when cleaning the filter 200H.

Whereas the present invention has been described in particular relation to the drawings attached hereto, it should be understood that other and further modifications apart from those shown or suggested herein, may be made within the scope and spirit of the present invention.

What is claimed is:

1. A filter for a drill string, the filter comprising:

a receptacle having an inner surface, an outer surface, and perforations providing a through passage between said inner surface and said outer surface, said receptacle having an upper end and a lower end;

a drilling mud intake disposed at said upper end;

a port disposed at said lower end; and a ball disposed at said port, said ball adapted to be displaced in an upward direction from a first location wherein said ball obstructs said port to a second location wherein said ball is spaced from said port.

2. The filter of claim 1, wherein said receptacle is a substantially conical shape.

3. The filter of claim 1, wherein said receptacle is disposed within a saver sub.

4. The filter of claim 1, wherein perforations include circle-shaped perforations.

5. The filter of claim 1, wherein said perforations include square-shaped perforations.

6. The filter of claim 1, wherein said receptacle includes a plurality of supporting rods and a wire wrapped about said plurality of supporting rods, said wire forming said inner surface and said outer surface.

7. The filter of claim 1, wherein said ball seats within said lower end of said receptacle.

8. A filter for a drill string, the filter comprising:

a receptacle having an inner surface, an outer surface, and perforations providing a through passage between said inner surface and said outer surface, said receptacle having an upper end and a lower end;

a drilling mud intake disposed at said upper end;

a port disposed at said lower end; and a plug disposed at said port, said plug adapted to be displaced in an upward direction from a first location wherein said plug obstructs said port to a second location wherein said plug is spaced from said port;

a shaft having a first end connected to said plug and a second end extending toward said upper end; and a spider connected to said upper end and to said second end.

9. The filter of claim 8, wherein said plug is a disc.

10. The filter of claim 8, wherein said plug includes a seal.

11. The filter of claim 8, wherein said plug seats within said inner surface at said lower end of said receptacle.

12. The filter of claim 8, the filter further comprising:

a fastener fastened to the exterior surface of said receptacle at said lower end, said fastener adapted to provide a seat for said plug and further adapted to be removable from said receptacle.

13. The filter of claim 8, wherein said exterior surface includes threads and said fastener is adapted to threadably fasten to said lower end of said receptacle.

14. The filter of claim 8, wherein said shaft includes bristles expending outward toward the inner surface of said receptacle.

* * * * *